US007003932B2

(12) United States Patent
Mavin

(10) Patent No.: US 7,003,932 B2
(45) Date of Patent: Feb. 28, 2006

(54) METHOD AND APPARATUS FOR APPLYING A THREADED CAP TO A THREADED NECK OF A CONTAINER

(75) Inventor: Gerry Mavin, Ashington (GB)

(73) Assignee: Portola Packaging Limited, Doncaster (GB)

( * ) Notice: Subject to any disclaimer, the term of this patent is extended or adjusted under 35 U.S.C. 154(b) by 0 days.

(21) Appl. No.: 10/726,220

(22) Filed: Dec. 1, 2003

(65) Prior Publication Data

US 2004/0216430 A1 Nov. 4, 2004

(30) Foreign Application Priority Data

Dec. 2, 2002 (GB) ..... 0228062

(51) Int. Cl.
*B65B 7/28* (2006.01)
*B67B 3/20* (2006.01)

(52) U.S. Cl. ..... 53/490; 53/317; 53/331.5

(58) Field of Classification Search ..... 53/490, 53/317, 331.5; B67B 3/20; B65B 7/28
See application file for complete search history.

(56) References Cited

U.S. PATENT DOCUMENTS 4,765,119 A 8/1988 Aidlin et al.
4,922,684 A * 5/1990 Nelson ..... 53/331.5
5,321,935 A * 6/1994 Spatz et al. ..... 53/490
6,105,343 A 8/2000 Grove et al.
6,158,196 A 12/2000 Trebbi et al.

FOREIGN PATENT DOCUMENTS

| | | | |
|---|---|---|---|
| DE | 288 815 A5 | | 4/1991 |
| EP | 0 618 168 A1 | | 10/1994 |
| EP | 1 132 331 A1 | | 9/2001 |
| EP | 1 249 426 A1 | | 10/2002 |
| GB | 732653 | | 6/1955 |
| GB | 2 121 390 A | | 12/1983 |
| JP | 01023987 A | * | 1/1989 |
| JP | 06115591 A | * | 4/1994 |
| JP | 08244888 A | * | 9/1996 |

* cited by examiner

*Primary Examiner*—Stephen F. Gerrity
(74) *Attorney, Agent, or Firm*—Dorsey & Whitney LLP

(57) ABSTRACT

A method and applicator for applying a threaded cap to a threaded neck of a container. The method includes the steps of placing the cap on the neck of the container, rotating the cap relative to the neck in an opening direction while supporting the cap with respect to the neck, and applying the cap to the neck so as to achieve substantial thread engagement. A reverse drive mechanism may be used with the applicator.

19 Claims, 4 Drawing Sheets

METHOD AND APPARATUS FOR APPLYING A THREADED CAP TO A THREADED NECK OF A CONTAINER

The present invention relates to a method and apparatus for applying a threaded cap to a threaded neck of a container.

The use of a threaded cap to close a container, where the container has a correspondingly threaded neck is well known. During packaging, after the container has been filled, it is necessary to apply the cap to the neck of the container to seal the contents of the container and prevent leakage. Typically this is a two stage process.

Initially the cap is placed on the neck of the container without substantial engagement of the threads. There are two commonly used methods of placing the cap on the container neck. In the first method, known as the "pick and place" method, a cap is collected by a capping head. The capping head suspends the cap in a substantially horizontal plane and the cap is either lowered onto the neck of the container or else the container is raised up to meet the cap.

The second method is known as the "pick-off" method. In this method, rather than the cap being suspended in a capping head and placed on the container neck, the caps are suspended above where the containers are transported, such that each cap is inclined with respect to the direction of motion of a respective container. The incline of the cap is such that the container neck contacts the inside of the cap and removes the cap from the suspension point. The cap is thereby placed on the neck without substantial engagement of the threads. Once the suspended cap has been removed from the suspension point another cap takes its place and the process is repeated with the next container.

Once the cap has been placed on the neck of the container there are then two common ways of applying the cap onto the neck of the container such that the threads are in substantial engagement. The first method of application is by means of an axially downward force which causes the threads of the cap to slide over those of the container and then interengage.

A second method of applying the cap to the container neck is by rotating the cap relative to the neck of the container. This rotation takes place in the direction of rotation of the threads and is designed so that a predetermined torque is achieved between the cap and the container with the result that the threads are in substantial engagement.

A common problem with the use of the previously described methods is that if the cap is not placed on the neck so that the threads of the cap are in alignment with those of the neck, the subsequent application of the cap can result in cross-threading.

In addition, since the neck and cap are commonly made of different materials, with different hardnesses, if the threads are initially cross-threaded, the subsequent forced application of the cap to the neck by either method can result in the threads becoming damaged. This in turn may lead to subsequent problems with leakage encountered by retailers, distributors and consumers alike. Also, if the threads are damaged, there may be a problem with leakage even if the cap is removed and subsequently applied correctly.

It is also known that when the threads of the cap and neck are cross-threaded the removal of the cap may be significantly more difficult than if the threads are in alignment. This can cause problems for users with weakened capability such as the elderly or sick.

It is therefore desired to provide an apparatus and method of minimising the risk of cross-threading during the application of a threaded cap onto a threaded neck of a container.

STATEMENT OF THE INVENTION

According to a first aspect of the present invention, there is provided a method of applying a threaded cap to a threaded neck of a container, the method comprising the steps of: placing the cap on the neck of the container; rotating the cap relative to the neck in an opening direction whilst supporting the cap with respect to the neck; and applying the cap to the neck so as to achieve substantial thread engagement.

This is advantageous because if the cap is placed on the neck of the container with the threads of the cap and neck in misalignment, the rotation of the cap in the opening direction will correct this misalignment. This means that the threads will settle into correct alignment prior to the application of the cap onto the neck of the container. This has the result that the problem of cross-threading is alleviated, thereby reducing the risk of leakage. In addition, the problem of thread damage is also addressed.

Advantageously, the cap may be rotated relative to the neck in an opening direction through an angle of at least 360°.

Preferably, the cap is rotated relative to the neck in an opening direction through an angle of between 36° and 720°.

Advantageously, the cap may be applied to the neck by means of an axial force which causes the threads on the cap and the threads on the neck to move past each other and then interengage. Alternatively, the cap may be applied to the neck by rotation of the cap relative to the neck in a closing direction.

In one embodiment of the present invention the cap may be drivingly rotated with respect to the neck by rotational drive means in both the opening and closing directions. Alternatively the cap may be drivingly rotated by rotational drive means in the closing direction and rotated against the rotational drive means in the opening direction.

According to a second aspect of the present invention, there is provided an applicator for applying a threaded cap to a threaded neck of a container to achieve substantial thread engagement, the applicator comprising: holding means for holding at least one of the cap and the container; application means for applying the cap to the neck such that the threads of the cap and the neck are substantially fully engaged; and means for rotating the cap relative to the neck in an opening direction whilst supporting the cap with respect to the neck, such that the threads of the neck and the cap are in alignment prior to application of the cap to the neck.

Advantageously, the application means may comprise means for applying an axial force to at least one of the cap and the neck in the direction of the other of the cap and the neck such that the threads on the cap and the threads on the neck move past each other and interengage. Alternatively, the application means may comprise means to rotate the cap relative to the neck in a closing direction. Preferably, the application means comprises rotational drive means.

Advantageously, the means for rotating the cap relative to the neck in an opening direction may comprise a second rotational drive means different from said rotational drive means to drivingly rotate the cap relative to the neck in a closing direction, the applicator further comprising means to selectively activate one of the two rotational drive means.

Alternatively, the rotational drive means may be coupled to the holding means via a gear box, the rotational drive means being adapted to selectively rotate the holding means in one of both an opening direction and a closing direction.

In a further alternative, the rotational drive means may be coupled to the holding means by clutch means, the holding means being adapted to be rotated against the clutch means in a direction opposite to the direction of rotation of the rotational drive means. Preferably, engagement means are provided to engage the holding means and rotate the holding means in an opening direction against the direction of rotation of the rotational drive means.

Advantageously, the engagement means comprises a first formation which positively engages with a second formation provided on the holding means, relative movement between the first and second formations causing the cap to rotate with respect to the neck in an opening direction. Alternatively, the engagement means comprises a first surface which frictionally engages a second surface provided on the holding means, relative movement between the first and second surfaces causing the cap to rotate with respect to the neck in an opening direction.

Advantageously, the duration of engagement between the engagement means and the holding means causes the cap to rotate with respect to the neck through an angle of at least 360°.

Preferably, the duration of engagement between the engagement means and the holding means causes the cap to rotate with respect to the neck through an angle of between 36° and 720°.

Advantageously, the applicator comprises a plurality of holding means, each for holding at least one of a respective cap and container combination, the rotational drive means being common to each of the plurality of holding means. Preferably, the rotational drive means is coupled to each of the plurality of holding means via respective clutch means such that one or more of the holding means may be rotated against the respective clutch means in a direction opposite to the direction of rotation of the rotational drive means while the remainder of the plurality of holding means are rotated in the direction of the rotational drive means. Preferably, the engagement means is common to the plurality of holding means.

According to a third aspect of the present invention, there is provided a reverse drive mechanism for use with an applicator for applying a threaded cap to a threaded neck of a container to achieve substantial thread engagement, the applicator comprising holding means for holding at least one of the cap and the container; rotational drive means to rotate the cap relative to the neck in a closing direction such that the threads of the cap and the neck are substantially fully engaged; and clutch means interposed between the rotational drive means and the holding means such that the holding means is adapted to be rotated against the clutch means in a direction opposite to the direction of rotation of the rotational drive means, the reverse drive mechanism comprising engagement means to engage the holding means and rotate the holding means in an opening direction against the direction of rotation of the rotational drive means whilst supporting the cap with respect to the neck such that the threads on the neck and the cap are in alignment prior to the rotational drive means rotating the cap relative to the neck in a closing direction.

Advantageously, the engagement means comprises a first formation which positively engages with a second formation provided on the holding means, relative movement between the first and second formations causing the cap to rotate with respect to the neck in an opening direction.

Alternatively, the engagement means may comprise a first surface which fictionally engages a second surface provided on the holding means, relative movement between the first and second surfaces causing the cap to rotate with respect to the neck in an opening direction.

Advantageously, the duration of engagement between the engagement means and the holding means causes the cap to rotate with respect to the neck through an angle of at least 360°.

Preferably, the duration of engagement between the engagement means and the holding means causes the cap to rotate with respect to the neck through an angle of between 36° and 720°.

BRIEF DESCRIPTION OF THE DRAWINGS

An embodiment of the present invention will now be described by way of example with references to the accompanying drawings in which.

DETAILED DESCRIPTION OF THE DRAWINGS

Figure 1:
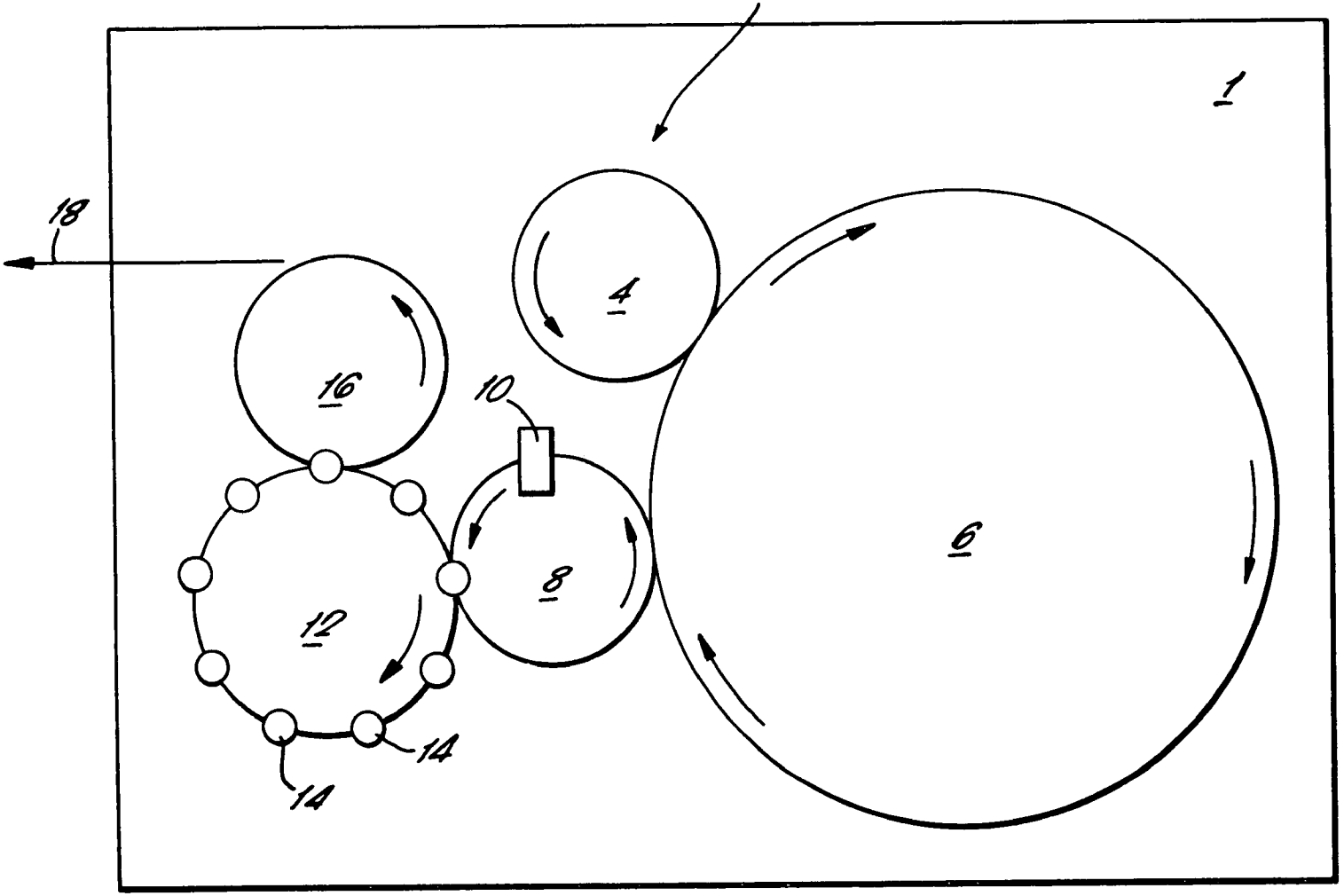
FIG. 1 shows a schematic plan view of a filling station embodying the present invention.

Referring to FIG. 1, there is shown an example of a filling station 2 in which containers, not shown, are filled, for example, with a liquid. The containers are then closed with a cap before moving on to be further processed if required. The neck of the container and the cap have complementary threads for resealable engagement of the container by the cap. It will be understood that either the cap will be internally threaded and the neck externally threaded or else the cap externally threaded and neck internally threaded.

As can be seen in FIG. 1, the containers enter the filling station at the container in-feed 2 and are transported onto a first transfer wheel 4. In the example shown, this transfer wheel rotates about an axis in an anticlockwise direction. The first transfer wheel 4 is located adjacent the filler 6 which is rotating about an axis in the opposite direction to the first transfer wheel 4. The filler 6 has a radius greater than that of the first transfer wheel 4.

Once the containers are transferred to the filler 6 they are transported around the circumference of the filler and are filled with the desired material, for example a potable liquid. Once the containers have been filled they continue around the circumference of filler 6 until they reach a second transfer wheel 8.

The second transfer wheel 8 rotates about an axis in a direction opposite to that of the filler 6, shown as anticlockwise. When the containers are transferred to the second transfer wheel 8 they move around the circumference of the second transfer wheel 8 and pass beneath a cap placement point 10. The cap placement point 10 is not shown in detail, but it is here that a cap is placed or otherwise rested on the neck of the container such that the threads of the cap and neck of the container are not significantly engaged. This placement may be by means of either the "pick and place" method or "pick-off" method previously described. At a point on the circumference of the second transfer wheel 8, after the containers have passed under the cap placement point 10, the containers are transferred to a capping station 12. Capping station 12 rotates about an axis in a direction opposite to that of the second transfer wheel 8, shown as clockwise.

The capping station 12 has a number of capping heads 14 which rotate about the axis of the capping station 12. When the container is being transported around the axis of the capping station 12, it is brought into contact with a capping head 14 and the cap is applied to the neck of the container such that the threads of the cap and the threads of the container become substantially fully engaged.

At a point on the circumference of the capping station 12, and after the cap has been applied to the container neck, the container is passed to a third transfer wheel 16. The third transfer wheel 16 rotates about an axis in a direction opposite to that of the capping station, shown as anticlockwise. The containers, which are now filled and sealed, are removed from the filling station 1 by the third transfer wheel 16 along out-feed 18 prior to any necessary further processing.

Figure 2:
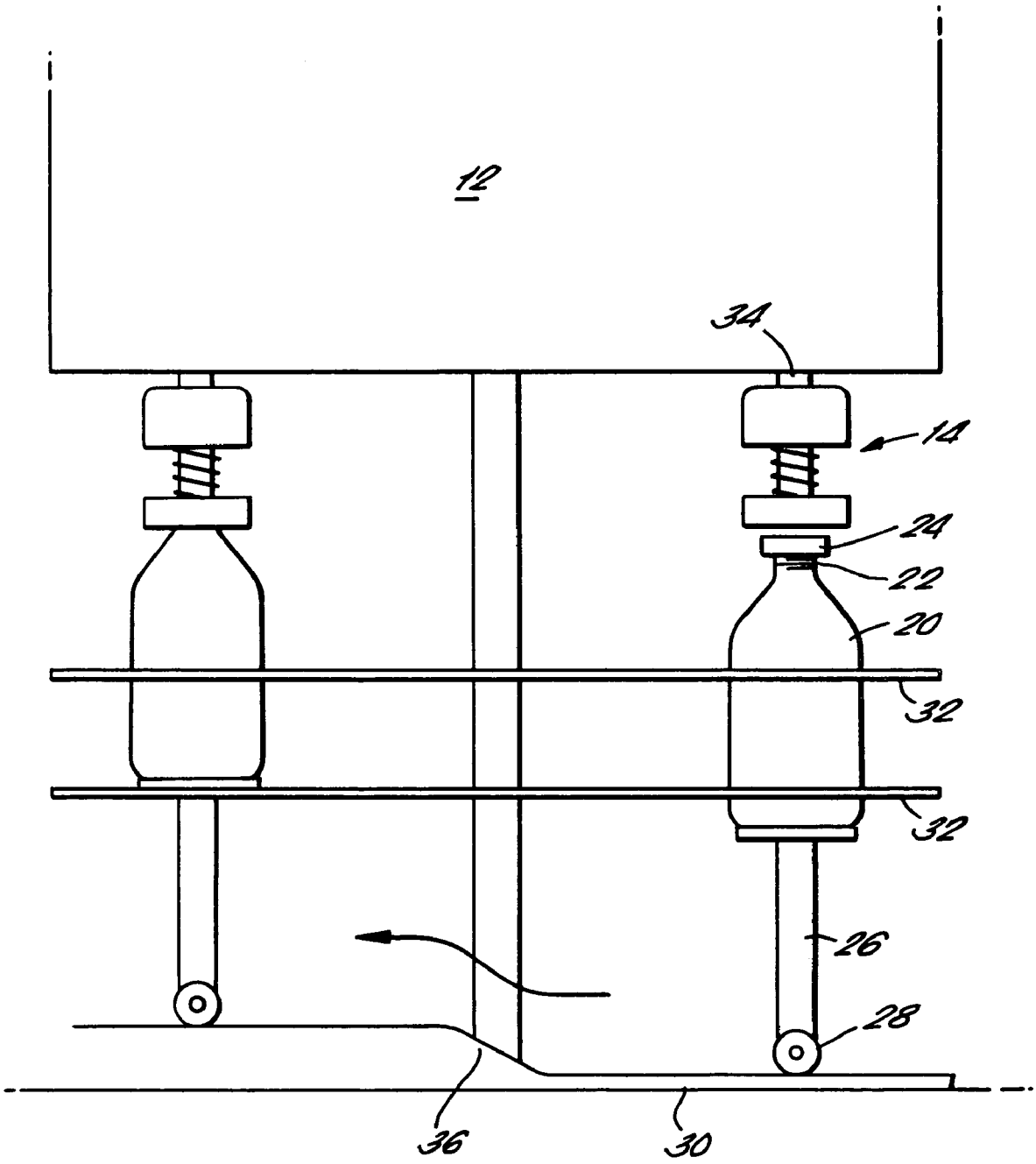
FIG. 2 shows a side view of a capping station of the filling station of FIG. 1.

FIG. 2 shows a side view of a capping station 12 such as that used in the filling station of FIG. 1. A container 20 has a neck 22 on which has been placed a cap 24. The container 20 is supported on a stand 26. The stand 26 is capable of translational motion by virtue of a rolling support member 28, the stand being located on a platform 30. The container 20 is held within two pairs of retaining rails 32 (only one of which is shown) located on opposite sides of the container 20. Located directly above container 20 is a capping head 14, which will be discussed in greater detail below. The capping head 14 is attached via shaft 34 to capping station 12.

The arrow on FIG. 2 shows the direction of motion of the container 20 as it moves in the capping station 12. The stand 26 and container 20 move at substantially the same speed as the capping head 14, so that the container 20 and capping head 14 remain in direct axial alignment. As the container moves along the platform 30 it is elevated at step 36, so that the cap 24 is received within the capping head 14. At this point it is possible for the final application of the cap 24 to the neck 22 to take place, so that the threads of the cap and the neck come into substantially full engagement.

Figure 3:
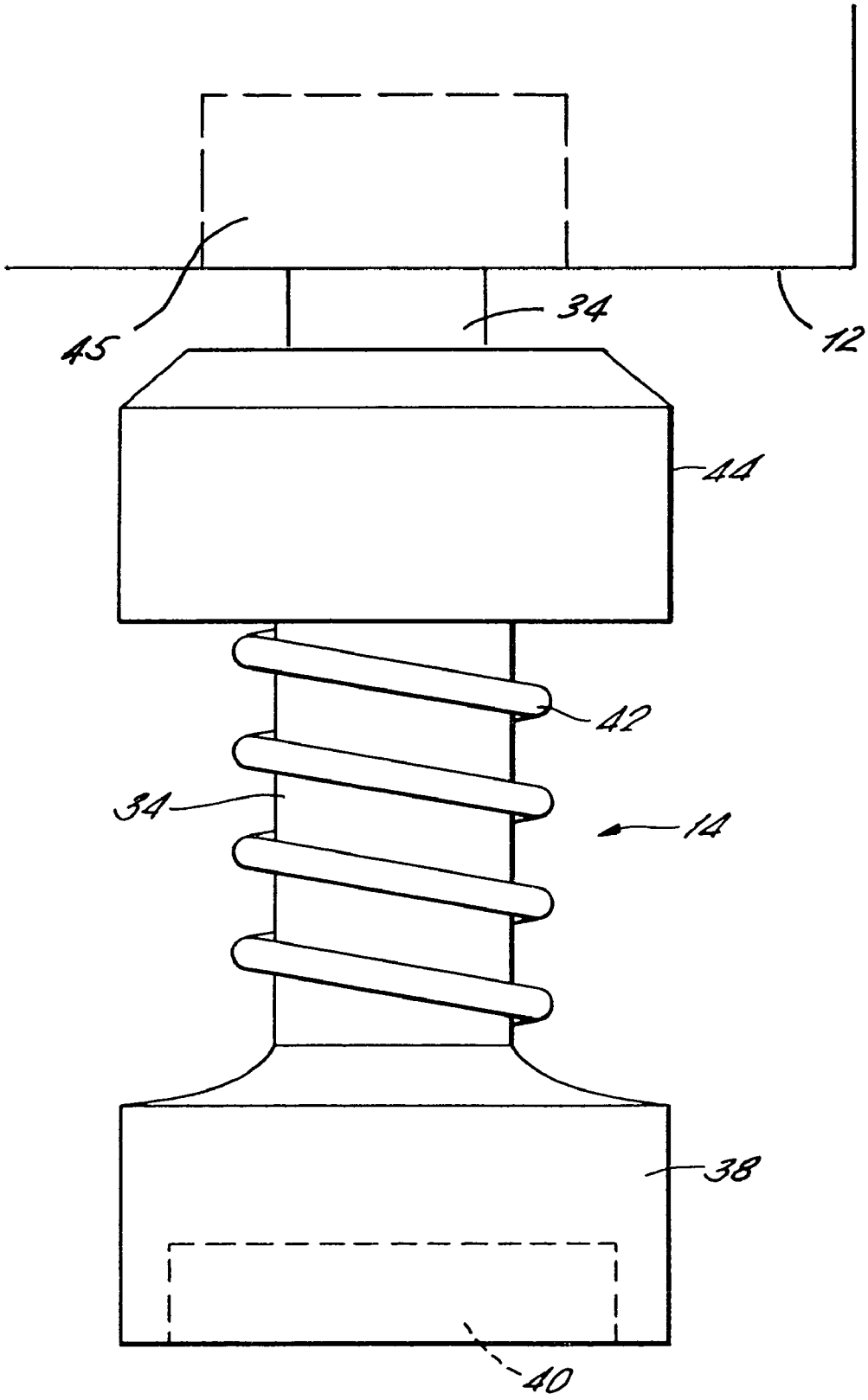
FIG. 3 shows a side view of a capping head used in the capping station of FIG. 2.

FIG. 3 shows a detailed side view of a capping head 14, such as that used in FIG. 2. The capping head comprises a chuck 38, in which is provided a cap recess 40. The cap recess 40 is sized such that a cap 24 received within the cap recess can be gripped sufficiently so that any torque applied to the capping head 14 will be directly applied to the cap 24. This transfer of torque from the capping head 14 to the cap 24 may be achieved by means of a frictional material within the cap recess 40, or by any other method, for example the positive engagement of a formation provided on the capping head with a corresponding formation provided on the cap.

The chuck 38 is coupled to shaft 24 via a head load spring 42. The head load spring 42 provides a resilience to the capping head 14 in the axial direction. Above the head load spring 42, the shaft 34 is attached to a clutch mechanism 44, which may take any of the following forms, electrical, magnetic or mechanical. The capping head 14 is then attached to a motor 45 (see FIG. 3), which provides rotational drive to the capping head 14, to rotate the cap 24 with respect to the container 20 until a predefined torque is achieved between the cap 24 and the neck 22.

As has been previously discussed, a problem has been identified in that the threads of the cap and neck can become cross-threaded during the initial placement of the cap on to the neck. A method of solving this problem is to initially rotate the cap in an opening direction, such that any misalignment is corrected, prior to subsequently applying the cap to the container neck.

In one embodiment of the present invention there is provided a capping head 14 which is coupled to both a first and a second motor. These motors provide rotational drive in both a clockwise and anticlockwise direction. One of these directions will rotate the cap 24 relative to the neck 22 in an opening direction and the other will rotate the cap 24 relative to the neck 22 in a closing direction. Means are provided on the capping station 12 to selectively couple the capping head 14 first to that motor which rotates the cap in the opening direction and then to that motor which rotates the cap in the closing direction. The ability of the capping station 12 to provide both an opening and closing rotation to the cap 24 will prevent any cross-threaded caps from being applied to the container neck and so remove one cause of subsequent leakage.

The capping head 14 in this particular embodiment rotates in an opening direction after the cap has been placed on the neck 22 of the container and after the cap has been received in the cap recess 40 of the capping head 14. This opening rotation should be through an angle sufficient to uncross the threads. For example in a cap having four starts the rotation is preferably through an angle of at least 90°. However, it will be understood that the opening rotation may be through any number of turns sufficient to remove cross-threading and may, for example, be through an angle within the range from 36° and 720°. Subsequent to the rotation in the opening direction the second rotational drive rotates the capping head 14, and therefore the cap 24, in a closing direction, until a predetermined torque is achieved between the cap and the neck of the container.

In a second embodiment of the present invention the capping head 14 is coupled to only one motor but that motor is in turn coupled to a gear box and the capping head is coupled to the output of the gear box. The gear box enables the rotational drive from the motor to be provided to the capping head 14 in either an opening or a closing direction. Again, means are provided to selectively actuate the gear box so that the capping head is initially rotated in an opening direction before subsequently being rotated in a closing direction. This results in a method of addressing the risk of cross-threading similar to that described with respect to the first embodiment, but without the need for a second rotational drive motor.

In a further embodiment of the invention a single motor is provided to rotate the capping head 14 in a direction that will rotate the cap in a closing direction with respect to the container neck. However, the motor is coupled to the capping head 14 by means of a clutch. The provision of a clutch enables the capping head to be forceably rotated in a direction opposite to the direction of rotation of the motor without damaging the motor or any of its constituent parts.

Figure 4:
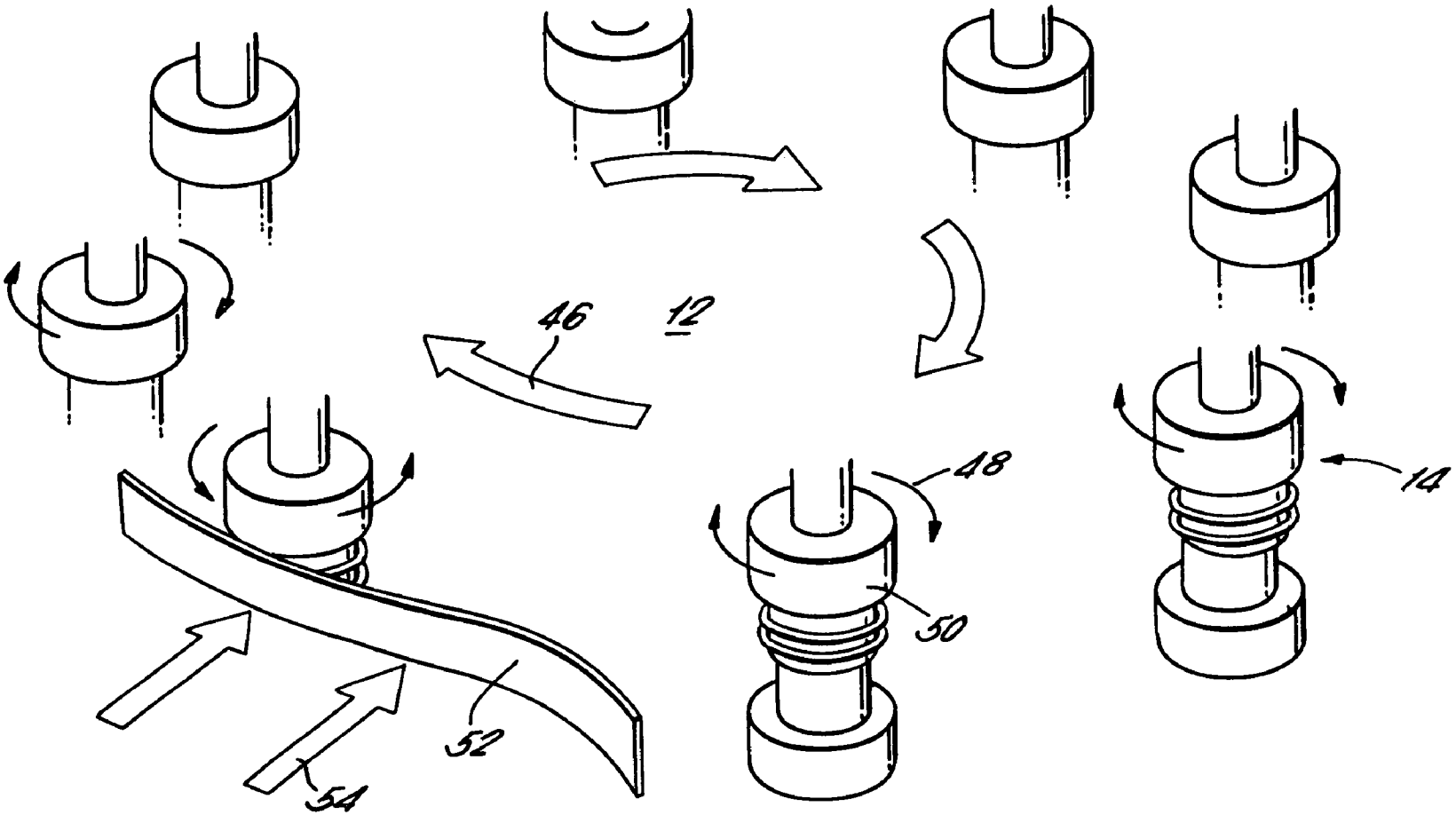
FIG. 4 shows a side elevation of a capping station embodying the present invention.

FIG. 4 shows part of a capping station in accordance with this further embodiment. The capping station 12 comprises eight capping heads 14 rotating in a circle indicated by arrows 46 about an axis of the capping station. In addition, each capping head 14 is rotating about its own axis, indicated by arrows 48, under the action of a common motor (not shown). However, each capping head 14 is coupled to that common motor by means of a respective clutch, also not shown. Each of the capping heads 14 is provided with a shoulder 50 which may be formed on the chuck 38 or else as an annular protrusion on the shaft 34. A plate 52 is provided to one side of the capping station 12 and as the capping heads 14 rotate about the axis of the capping station as indicated by arrows 46 so each of the shoulders in turn engage a surface of plate 52. As the capping heads 14 continue to rotate about the axis of the capping station 12 so the shoulder 50 slides along the plate 52. At the same time, the frictional engagement between the shoulder 50 and the plate 52 causes the capping head in engagement with the plate to rotate against its clutch in a direction opposite to that in which it is being driven by the motor. This in turn results in the cap received within the chuck 38 being rotated in an opening direction with respect to the container neck. However, as soon as the capping head 14 moves out of engagement with the plate 52, the frictional engagement responsible for the reverse rotation is removed thereby enabling the motor to resume rotation of the chuck 38 in a direction that will be rotate the cap in a closing direction with respect to the container neck. This particularly elegant means of providing a reverse drive can be retrofitted to existing capping machines to alleviate the problems associated with cross-threading between caps and container necks. The plate 52 is preferably of a length to ensure a reverse rotation of at least 360° although it will be understood that, depending on the number of starts and the length of the threads involved, a reverse rotation of between 36° and 720° may be sufficient to alleviate the problem. Preferably the plate 52 is biaised in the direction of arrows 54 to ensure the necessary frictional engagement with shoulder 50.

Although in this last embodiment the reverse rotation of the capping head 14 has been described as by means of the frictional engagement of the plate 52 with the shoulders 50, it will be understood that means may be provided to positively engage each of the capping heads in turn and so rotate the capping head against the clutch in a direction opposite to the direction of rotation of the motor. For example, the plate 52 may be replaced by a rack having teeth which might engage with corresponding teeth provided on the capping heads 14.

What is claimed is:

1. A method of applying a threaded cap to a threaded neck of a container, the method comprising the steps of:

placing the cap on the neck of the container;

rotating the cap relative to the neck in an opening direction while supporting the cap with respect to the neck; and applying the cap to the neck by rotation of the cap relative to the neck in a closing direction so as to achieve substantial thread engagement, the cap being drivingly rotated by rotational drive means in the closing direction and being rotated against the rotational drive means in the opening direction.

2. A method as claimed in claim 1, wherein the cap is rotated relative to the neck in an opening direction through an angle of at least 360°.

3. A method as claimed in claim 1, wherein the cap is rotated relative to the neck in an opening direction through an angle of between 360° and 720°.

4. A method of applying a threaded cap to a threaded neck of a container, the method comprising the steps of:

placing the cap on the neck of the container;

rotating the cap relative to the neck in an opening direction while supporting the cap with respect to the neck; and applying the cap to the neck by rotation of the cap relative to the neck in a closing direction so as to achieve substantial threaded engagement, the cap being drivingly rotated with respect to the neck by a first rotational drive means in a closing direction and being drivingly rotated by a second rotational drive means, different from said first rotational drive means, in the opening direction.

5. An applicator for applying a threaded cap to a threaded neck of a container to achieve substantial thread engagement, the applicator comprising:

holding means for holding at least one of the cap and the container;

application means for applying the cap to the neck such that the threads of the cap and the neck are substantially fully engaged including rotational drive means to rotate the cap relative to the neck in a closing direction, said rotational drive means being coupled to said holding means via clutch means, said holding means being adapted to be rotated against said clutch means in a direction opposite to the direction of rotation of said rotational drive means; and means for rotating the cap relative to the neck in an opening direction whilst supporting the cap with respect to the neck, such that the threads of the neck and the cap are in alignment prior to application of the cap to the neck.

6. An applicator as claimed in claim 5, wherein engagement means are provided to engage said holding means and rotate said holding means in an opening direction against the direction of rotation of said rotational drive means.

7. An applicator as claimed in claim 6, wherein said engagement means comprises a first formation which positively engages with a second formation provided on said holding means, relative movement between said first and second formations causing said cap to rotate with respect to the neck in an opening direction.

8. An applicator as claimed in claim 6, wherein said engagement means comprises a first surface which frictionally engages a second surface provided on said holding means, relative movement between said first and second surfaces causing said cap to rotate with respect to the neck in an opening direction.

9. An applicator as claimed in claim 6, wherein the duration of engagement between said engagement means and said holding means causes said cap to rotate with respect to the neck through an angle of at least 360°.

10. An applicator as claimed in claim 6, wherein the duration of engagement between said engagement means and said holding means causes said cap to rotate with respect to the neck through an angle of between 36° and 720°.

11. An applicator as claimed in claim 5, comprising a plurality of holding means, each for holding at least one of a respective cap and container combination, said rotational drive means being common to each of said plurality of holding means.

12. An applicator as claimed in claim 11, wherein said rotational drive means is coupled to each of said plurality of holding means via respective clutch means such that one or more of said holding means may be rotated against said respective clutch means in a direction opposite to the direction of rotation of said rotational drive means while the remainder of the plurality of holding means are rotated in the direction of said rotational drive means.

13. An applicator as claimed in claim 12, wherein an engagement means is common to said plurality of holding means.

14. An applicator for applying a threaded cap to a threaded neck of a container to achieve substantial thread engagement, the applicator comprising:

holding means for holding at least one of the cap and the container;

application means for applying the cap to the neck such that the threads of the cap and the neck are substantially fully engaged including first rotational drive means to rotate the cap relative to the neck in a closing direction;

means for rotating the cap relative to the neck in an opening direction including a second rotational drive means different from said first rotational drive means to drivingly rotate the cap relative to the neck in a closing direction; and means to selectively activate one of said two rotational drive means.

15. A reverse drive mechanism for use with an applicator for applying a threaded cap to a threaded neck of a container to achieve substantial thread engagement, the applicator being of the type including holding means for holding at least one of the cap and the container, rotational drive means to rotate the cap relative to the neck in a closing direction such that the threads of the cap and the neck are substantially fully engaged, and clutch means interposed between said rotational drive means and said holding means such that the holding means is adapted to be rotated against said clutch means in a direction opposite to the direction of rotation of said rotational drive means, the reverse drive mechanism comprising:

engagement means to engage said holding means and rotate said holding means in an opening direction against the direction of rotation of said rotational drive means whilst supporting the cap with respect to the neck such that the threads on the neck and the cap are in alignment prior to said rotational drive means rotating the cap relative to the neck in a closing direction.

16. A reverse drive mechanism as claimed in claim 15, wherein said engagement means comprises a first formation which positively engages with a second formation provided on said holding means, relative movement between said first and second formations causing said cap to rotate with respect to the neck in an opening direction.

17. A reverse drive mechanism as claimed in claim 15, wherein said engagement means comprises a first surface which frictionally engages a second surface provided on said holding means, relative movement between said first and second surfaces causing said cap to rotate with respect to the neck in an opening direction.

18. A reverse drive mechanism as claimed in claim 15, wherein the duration of engagement between said engagement means and said holding means causes said cap to rotate with respect to the neck through an angle of at least 360°.

19. A reverse drive mechanism as claimed in claim 15, wherein the duration of engagement between said engagement means and said holding means causes said cap to rotate with respect to the neck through an angle of between 36° and 720°.

* * * * *